United States Patent [19]

Cropp

[11] Patent Number: 4,720,358

[45] Date of Patent: Jan. 19, 1988

[54] ZONED HOT WATER DISTRIBUTION SYSTEM FOR COUNTERFLOW TOWERS

[75] Inventor: Kenton A. Cropp, Edgerton, Kans.

[73] Assignee: The Marley Cooling Tower Company, Mission, Kans.

[21] Appl. No.: 10,188

[22] Filed: Feb. 2, 1987

[51] Int. Cl.[4] ..... B01F 3/04

[52] U.S. Cl. ..... 261/111; 261/DIG. 11

[58] Field of Search ..... 261/111, 110, DIG. 11

[56] References Cited

U.S. PATENT DOCUMENTS

| | | | |
|---|---|---|---|
| 3,115,534 | 12/1963 | Bottner | 261/110 |
| 3,322,409 | 5/1967 | Reed | 261/111 |
| 4,032,604 | 6/1977 | Parkinson et al. | 261/111 |
| 4,129,625 | 12/1978 | Fordyce et al. | 261/111 |
| 4,208,359 | 6/1980 | Bugler, III et al. | 261/111 |
| 4,579,692 | 4/1986 | Bugler, III et al. | 261/111 |

FOREIGN PATENT DOCUMENTS

| | | | |
|---|---|---|---|
| 2512397 | 10/1975 | Fed. Rep. of Germany | 261/111 |

*Primary Examiner*—Tim Miles

*Attorney, Agent, or Firm*—Schmidt, Johnson, Hovey & Williams

[57] ABSTRACT

A distribution system for a water cooling tower directs incoming hot water to particular regions of a fill assembly which are determined by the magnitude of the hot water flow rate, and structure is provided for maintaining an equal head of water above all of the nozzles in current operation. During periods of relatively low flows, a weir member mounted within a distribution box of the system directs all of the incoming hot water to an outer distribution zone which is located over four outer regions of the fill assembly. Once the hot water flow rate is increased above as certain, predetermined value, a portion of the water spills over the weir and is conveyed to an inner distribution zone located over a central region of the fill structure while the remaining portion of the water is directed toward the outer zone so that water is directed to the entire horizontal area of the fill structure. Variations in the hot water flow rate either above or below the aforementioned, predetermined value function to raise or lower the pressure encountered by the nozzles, but the configuration of the weir member, distribution box and distribution conduits ensures that all of the nozzles in current operation continuously encounter an equal head of water without the use of valves, gates or the like.

8 Claims, 9 Drawing Figures

ZONED HOT WATER DISTRIBUTION SYSTEM FOR COUNTERFLOW TOWERS

BACKGROUND OF THE INVENTION

1. Field of the Invention

The present invention relates to a cooling tower distribution system which directs hot water to be cooled exclusively to water dispersing nozzles above outer regions of a fill assembly whenever the flow rate of hot water is less than a certain value, and which directs water to nozzles above the entire assembly, including the outer regions as well as a central region, whenever the flow rate exceeds the aforementioned certain value. Fixed structure is provided for equalizing the water pressure among all of the nozzles in current operation regardless of momentary or long term variations in the rate of water flow.

2. Description of the Prior Art

Water which has been used to condense steam generated by a boiler for production of electricity or in connection with other processes where steam is used as a motive fluid is often cooled at a point in the process cycle by means of a cooling tower. Electric utilities, for example, often employ very large, natural draft concrete towers wherein quantities of initially hot water are sprayed downwardly by nozzles toward a fill assembly, while natural, convective air currents rise through the tower including the fill assembly in direct opposition to the descending water for cooling the latter.

In general, towers are sized to provide sufficient cooling for the process water during summer days when the highest ambient air temperatures are approached and the volumetric flow rate of water through the tower is at a maximum, taking into account the overall performance of the tower. As a consequence, most of the time the tower produces cold water at a temperature below the design point. This is generally desirable as it increases the efficiency of the steam generating unit. There are times, however, when the power plant is operating at partial load and/or the ambient air temperature is below the freezing point of water. Under these conditions the general practice is to reduce the quantity of water being circulated to the tower to be cooled. The reduction in volumetric flow of water to the tower is usually accomplished either by bypassing the tower with a portion of the water used in the condensing process or by reducing the number of pumps used to supply water for the condensing process.

In these times of reduced water flow rates to the tower there are two primary concerns. For the tower to perform effectively, the water must be distributed uniformly. Also, when the ambient air temperature is below freezing, all portions of the tower which are directly exposed to the coldest air must have a concentration of water sufficient to minimize the formation of ice. The problem of ice is particularly troublesome because the air inlet face of the tower can become clogged to such an extent that air flow through the fill structure is significantly hindered, thereby lowering tower effectiveness. Moreover, damage to fill structure and other tower components can result due to the weight of the ice.

The nature of water distribution nozzles often used in cooling towers is another factor which must be taken into consideration during operation of the tower in relatively cold ambient conditions. One type of nozzle which has been found to be particularly useful for even, uniform distribution of water over fill structure at varying flow rates is the nozzle assembly described in U.S. Pat. No. 4,208,359 dated June 17, 1980 and assigned to the assignee of the present invention. In nozzles in general, including the type illustrated in U.S. Pat. No. 4,208,359, the flow rate of water through the nozzle is a function of the square root of the head of water encountered by the nozzle, and consequently a certain minimum, theoretically desired flow rate is established for proper operation of the nozzle so that the water is evenly distributed over the underlying fill structure in a uniform, wideangle dispersion pattern to avoid areas of low water concentration in the fill structure and formation of iced regions.

In some instances, the fill assembly of conventional counterflow towers is divided into a peripheral, outer region adjacent the tower shell defining the air passageway, and an inner region which is surrounded by the outer region. During winter operation of such towers, motor operated valves or gates are actuated to direct hot water to be cooled only toward the nozzles above the outer region of the fill assembly, so that as the volumetric flow rate of water is lowered in proportion to the reduced demands of the process, the nozzles distribute an adequate amount of water to the working regions of the fill structure to avoid ice formation. In natural draft towers, the supply of hot water to a peripheral region of the tower presents a water "curtain" to incoming air in order to partially counteract the natural convection of the tower that is enhanced during cold weather conditions.

Unfortunately, electrically actuated valves and gates for the relatively large diameter conduits carrying the hot water to the fill structure represent a significant cost, both in terms of initial capital outlay as well as expenses for periodic mechanical maintenance and electrical service. In addition, since the fill structure is generally open to the atmosphere, the cooling water often becomes contaminated with particulates such as twigs, leaves, scale and other objects which may tend to hinder operation of the valves. In some cases, plastic or synthetic rubber-like cleaning balls are intentionally placed in the cooling water to clear heat exchange tubes of the condenser, and such balls can occasionally become lodged in the valves, preventing operation and requiring manual intervention. Water for the process is sometimes drawn from a river with minimal treatment, and understandably foreign objects in river water can also be particularly troublesome.

SUMMARY OF THE INVENTION

In accordance with the present invention, a zoned hot water distribution system is provided for counterflow towers, and incoming hot water to be cooled is directed without the use of movable valves or gates toward particular locations of the fill assembly which are determined by the magnitude of the hot water flow rate. Whenever the flow rate falls below a certain predetermined value, incoming hot water is directed toward four peripheral or outer regions of the fill assembly, and whenever the flow rate rises above the aforementioned value, incoming hot water is delivered to a central, inner region of the fill assembly as well as the four outer regions.

Importantly, structure is provided for equalizing the pressure of hot water that is encountered by each of a number of nozzles which are in current use for dispersing water to underlying portions of the fill assembly. During periods of low flow rates when water is distributed only to the outer regions of the fill assembly, each nozzle associated with the outer regions encounters an equal pressure so that localized hot or cold spots within the fill assembly are avoided and a uniform, peripheral "curtain" of water drops from the fill assembly around the entire circumference of the tower shell to reduce the velocity of air entering the tower. As the volumetric flow rate of incoming hot water increases above the selected, predetermined value, and water is conveyed to all of the nozzles across the entire horizontal area of the fill assembly, the pressure of water is equalized among all of the nozzles, including nozzles associated with both the outer regions of the fill assembly as well as the inner, central region of the same. Any variation of the hot water flow rate correspondingly changes the pressure encountered by the nozzles, but at all times each nozzle that is operating to disperse water encounters the same pressure which is received by other nozzles in simultaneous operation.

In more detail, a water supply riser extends upwardly through the center of the tower and terminates in a distribution box. Four closed conduits are radially arranged in a horizontal direction from the distribution box toward the four outer regions, and two additional closed conduits coupled to the box extend along the inner, central region. A number of transverse distribution pipes communicate with the closed conduits and are located at a common elevation both within the inner and outer distribution zones, and each distribution pipe supplies water to a number of dispersing nozzles located above corresponding regions of the fill assembly. During times that the incoming hot water flow rate is less than 30% of the maximum flow rate or full load capacity of the tower, the level of water in the riser remains below a weir member which prevents water from flowing to the two conduits for distribution in the central zone, and instead all of the water is directed to the remaining four conduits having inlets in the riser located below the weir member, for delivery of all of the water to the outer four regions. In instances where the flow rate exceeds 30% of maximum capacity, a portion of the hot water conveyed upwardly through the riser overflows the weir member and advances through the two conduits for delivery to the central distribution zone, while the remaining portion of the water is supplied to the other four conduits for distribution within the outer zone or four outer regions.

As a consequence, automatic, zoned operation of the tower is provided without the need for any moving parts such as electrically actuated gates, valves or other types of apparatus to control the flow of hot water to certain zones of the tower. Elimination of gates and valves reduces maintenance and avoids problems associated with large particulate debris which may possibly be circulating with the water through the entire system. The tower is well adapted for locations in remote, wilderness areas where automatic, zoned distribution control is desirable without the need for any substantial manual intervention.

DETAILED DESCRIPTION OF THE DRAWINGS

Figure 1:
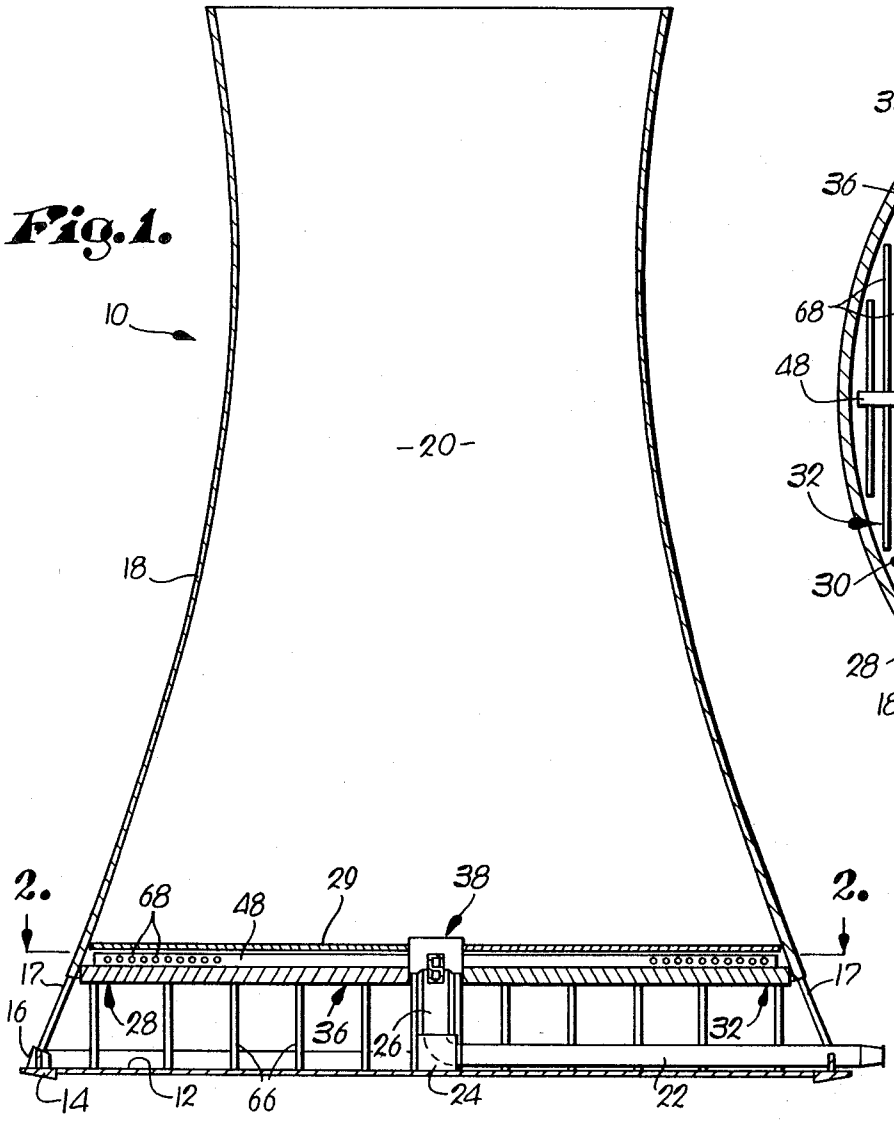
FIG. 1 is a side cross-sectional view of a generally hyperbolic natural draft counterflow evaporative cooling tower having the zoned hot water distribution system of the present invention, illustrating a main inlet pipe leading to a central riser that extends through the center of a fill assembly located beneath horizontal distribution conduits communicating with the riser.

Referring initially to FIG. 1, a natural draft hyperbolic cooling tower broadly designated by the numeral 10 has a bottom, concrete base comprising a collection basin 12 as well as a circular, peripheral ring beam 14 that underlies a number of inclined, upright plinths 16 which in turn carry the weight of a concrete, upright wall means or shell 18 transmitted through sloped columns 17. The shell 18 is of a generally hyperbolic configuration in vertical section and defines an upright air passageway 20 therethrough. Air is drawn into the tower 10 in the spaces between the columns 17 and thence upwardly by means of natural draft, convective forces.

Figure 5:
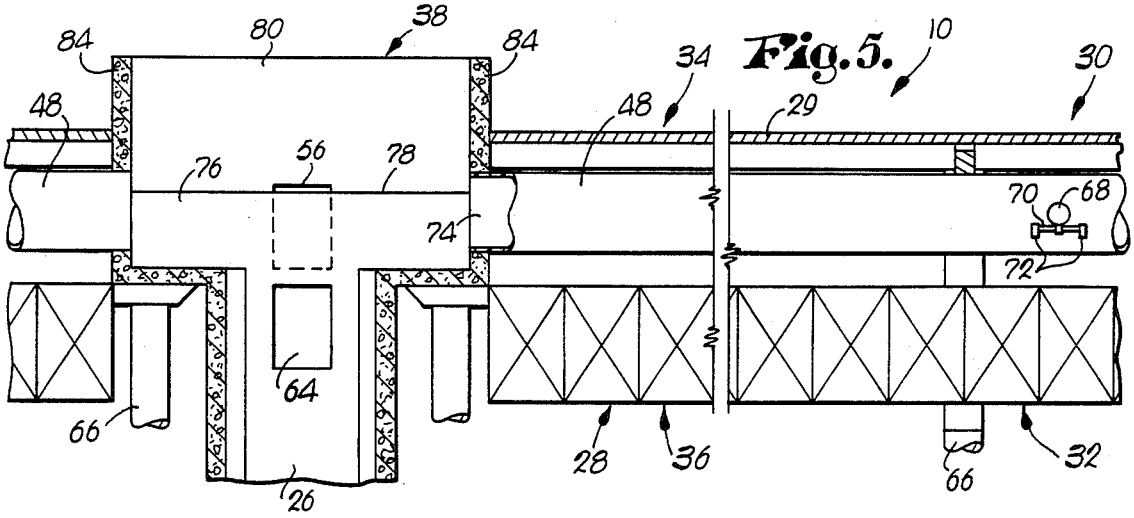
FIG. 5 is an enlarged, fragmentary, vertical sectional view taken along line 5—5 of FIG. 4 and further illustrating two cylindrical, synthetic resinous distribution conduits which extend in transverse relationship to the conduits formed of concrete illustrated in FIG. 4, also showing a portion of the fill assembly located beneath the distribution conduits.
Figure 6:
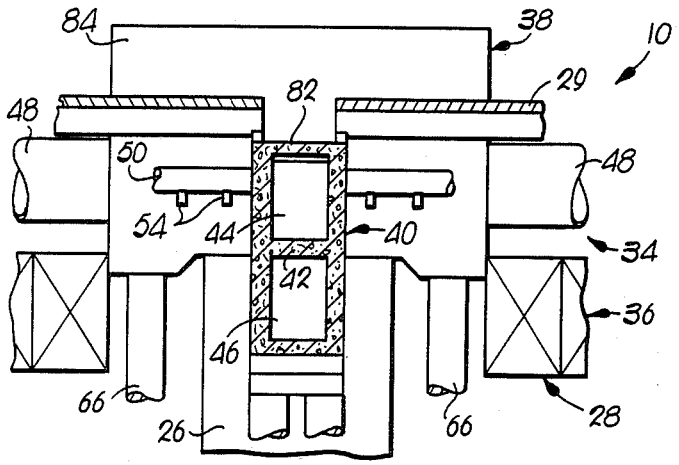
FIG. 6 is an enlarged, fragmentary, vertical sectional view taken along line 6—6 of FIG. 4, further illustrating the configuration of the horizontal, closed concrete conduits and the orientation of one of the transverse distribution pipes connected to one of the conduits.

A relatively large diameter, horizontal inlet pipe 22 extends above and across the collection basin 12 and terminates at a thrust block 24 which functions as a base for a riser means or riser 26. The riser 26 passes upwardly through the center of the tower 10 as well as through the middle of a fill assembly 28 which lies in a horizontal plane and is closely bounded by a lower portion of tower shell 18. Spaced above and parallel to the fill assembly 28 is a drift eliminator 29 which is also illustrated in FIGS. 4–6.

Figure 2:
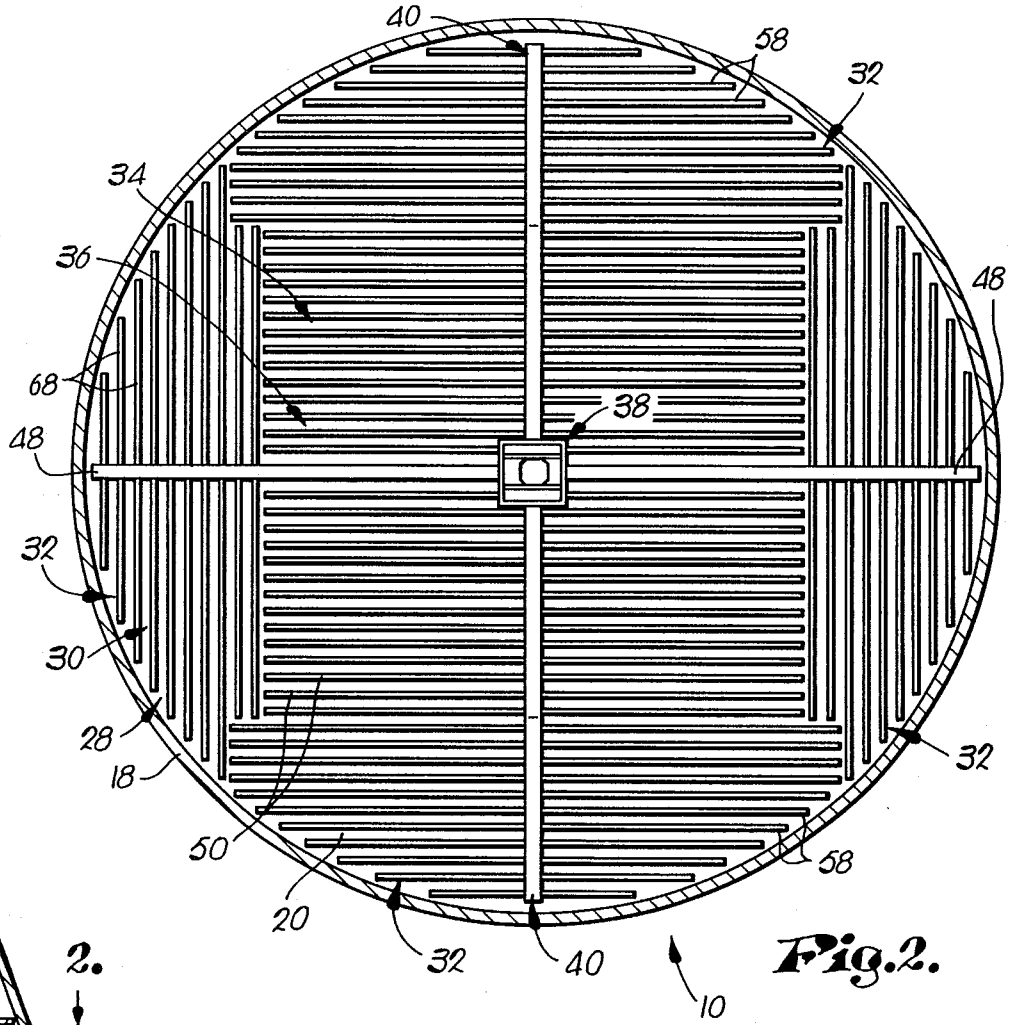
FIG. 2 is an enlarged horizontal view in partial section taken along line 2—2 of FIG. 1 and depicting four outer regions of the fill assembly, a central, inner region of the fill assembly and the radially extending distribution conduits located above the fill assembly.

The horizontal cross section of tower 10 above the fill assembly 28 is divided into an outer, peripheral distribution zone 30 which is located over a first, peripheral region of the fill assembly 28 that comprises four generally crescent shaped regions 32 (see FIG. 2). An inner, central distribution zone 34 lies above a second, inner or central square region 36 of the fill assembly 28 which in turn is located within a central region of the air passageway 20.

Figure 3:
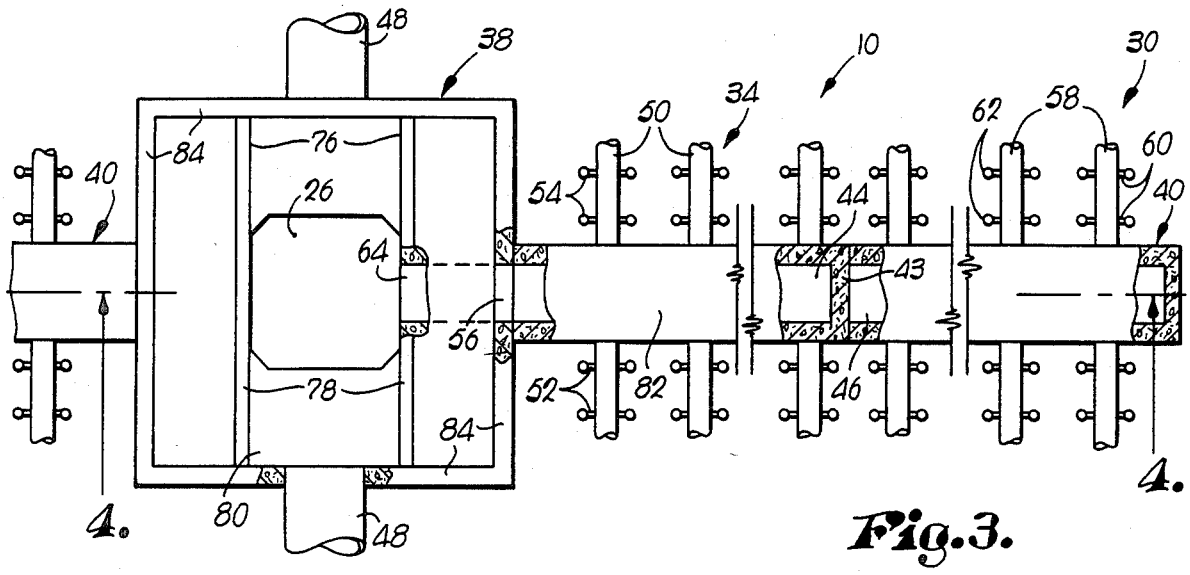
FIG. 3 is a fragmentary, enlarged plan view with parts broken away in section of a central distribution box located at the top of the riser shown in FIGS. 1 and 2, illustrating in further detail some of the closed distribution conduits which are each connected to a number of transverse distribution pipes for conveying water to branch arms and associated nozzle assemblies.

Referring now to FIGS. 3–6, a central distribution box 38 is located at the top of the riser 26 and is preferably constructed from precast or poured-in-place concrete materials. Elongated conduit means connected to the box 38 and thereby to the riser 26 for receiving hot water from the latter includes two concrete, horizontally extending distribution conduits 40 which are partitioned by a horizontal wall 42 and upright wall 43 into an upper conduit 44 and a lower conduit 46 (see FIG. 4), and the conduit means also comprises two additional, horizontally extending cylindrical conduits 48 which may optionally be formed of synthetic resinous materials. As shown in FIG. 3, the two cylindrical distribution conduits 48 radiate in opposite directions away from two opposed sides of the distribution box 38, while the distribution conduits 40 including the two upper conduits 44 and the two lower conduits 46 extend in opposite direction from the box 38 in a direction transverse to the longitudinal axes of cylindrical conduits 48.

Figure 4:
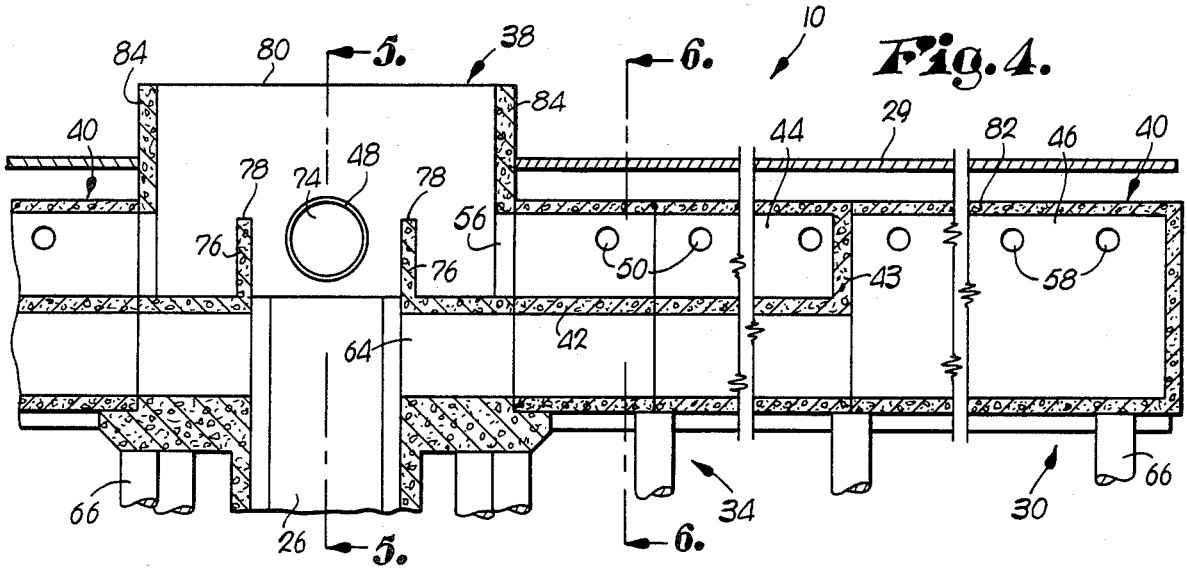
FIG. 4 is an enlarged, fragmentary, vertical sectional view taken along line 4—4 of FIG. 3 to show a weir member and stilling chamber forming a part of the distribution box along with a portion of the horizontal distribution conduits for both the inner and outer zones, with all of the distribution pipes being located at a common elevation.

Referring to FIGS. 3 and 4, each of the elongated upper conduits 44 are connected to transversely extending, cylindrical distribution pipes 50 which extend throughout the inner distribution region 34 (see also FIG. 2). A number of tubular branch arms 52 are connected to the distribution pipes 50 at spaced locations along the latter, and water dispersing nozzles 54 are coupled to each end of the branch arms 52 for directing water to the underlying central region 36 of fill assembly 28. The inner end of each upper conduit 44 terminates in an opening 56 formed in the distribution box 38 above partition wall 42, as can be best appreciated by reference to FIGS. 4 and 5.

The lower conduits 46 each extend beneath a corresponding upper conduit 44 (see FIG. 6), and outboard of the termination of the upper conduits 44 the height of the internal cross-sectional area of the lower conduits 46 is increased to the height of the upper conduits 44. A number of distribution pipes 58 are connected to the lower conduits 46 outboard of the upper conduits 44 as shown in FIGS. 3 and 4 to provide water to two of the four outer regions 32 located on opposite sides of the tower 10. A plurality of branch arms 60 are transversely coupled to each distribution pipe 58 at spaced locations along the latter, and two nozzle assemblies or nozzles 62 are in turn connected to opposite ends of each branch arm 60. The inboard end of each lower conduit 46 communicates with an opening 64 (FIGS. 3–5) formed in the distribution box 38, and a number of support columns 66 resting on the upper surface of collection basin 12 support the conduits 40 as well as the distribution box 38.

The two cylindrical conduits 48 which extend transversely to conduits 40 are each connected to a number of distribution pipes 68 that lie over the remaining two outer regions 32 which are not served by distribution pipes 58. Viewing FIG. 5, each of the distribution pipes 68 carries and communicates with a number of spaced branch arms 70 that in turn supply water to nozzle assemblies 72 located at each end of arms 70. The inboard end of each cylindrical conduit 48 extends through an opening 74 in the box 38, and the two conduits 48 are imperforate in segments between the opening 74 and the first encountered distribution pipe 68.

As depicted in FIGS. 3 and 4, two upright weir members 76 are connected to the inner end of horizontal partition walls 42 and extend transversely across the entire width of distribution box 38, presenting two upper weir edges 78 of equal height. The horizontal, internal area of the distribution box 38 is substantially larger than the horizontal cross-sectional area of riser 26, and has four upright walls 84 that present a square-in-cross-section stilling chamber 80 which may be open to the atmosphere as shown. Walls 84 extend above the riser 26 and surround weir members 76.

Each of the distribution pipes 50, 58 and 68 is located at a common elevation which is slightly below the upper weir edges 78 of weir members 76. In addition, it is preferable that the distribution conduits 40 are each covered with a closed top 82, although other configurations are possible.

OPERATION

In use, hot water from a steam plant for electric generation or other type of process is directed along the inlet pipe 22 and thence upwardly through the riser 26 for distribution to the fill assembly 28. At the same time, air drawn by natural convection forces is admitted to the tower 10 between columns 17, for upward travel through the fill assembly 28, the drift eliminator 29 and the remaining regions of the air passageway 20 until being discharged at the top of the tower 10 into the atmosphere.

Whenever the flow rate of incoming hot water passing through the riser 26 is less than a certain, preselected value which for the tower 10 illustrated is 30% of maximum, full load capacity, the level of water within the distribution box 38 remains below the upper weir edges 78 and is directed only through the two openings 64 leading to the two lower conduits 46, and the two openings 74 in communication with the cylindrical conduits 48. Thus, as long as the level of water does not rise above weir edges 78, only the distribution pipes 58, 68 are supplied with water and nozzles 62, 72 respectively disperse the hot water only to the four outer regions 32 of the fill assembly 28 located beneath the outer distribution zone 30.

Figure 7:
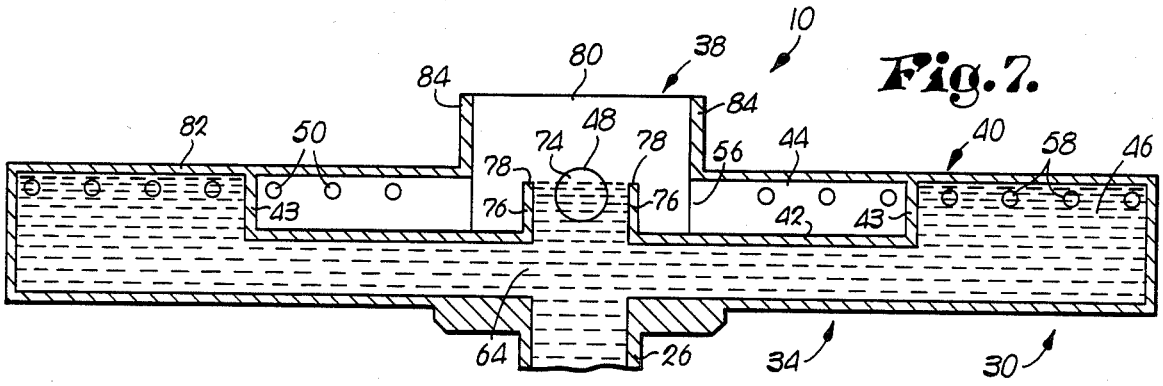
FIG. 7 is a fragmentary, enlarged, vertical sectional view depicted out-of-scale to schematically show the level of water within the distribution box and conduits when the flow rate of the incoming water is 30% of full load tower capacity.
Figure 8:
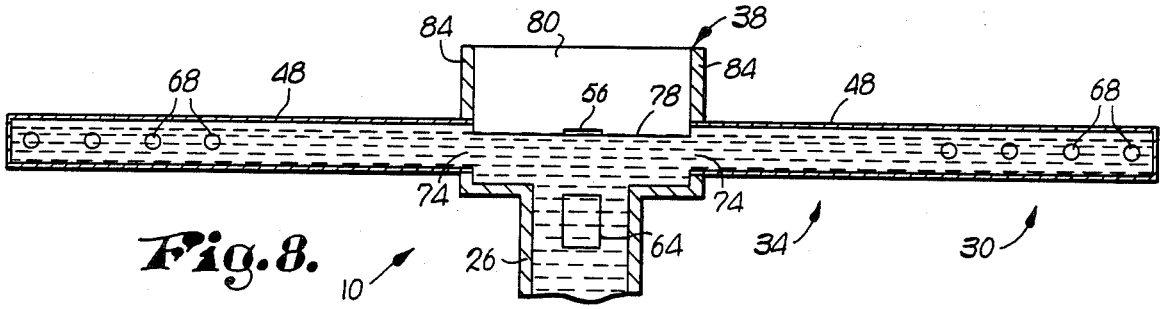
FIG. 8 is a vertical sectional view somewhat similar to FIG. 7 but taken along a plane perpendicular to the plane of view of FIG. 7 to illustrate the level of water in the cylindrical conduits during flow rates equaling 30% of capacity.

FIGS. 7 and 8 are illustrative of the level of water within the distribution system when the flow rate of hot water through the riser 26 is equal to 30% of maximum, full load capacity of tower 10. The level of water in FIGS. 7 and 8 in the lower conduits 46 as well as in the cylindrical conduits 48 is indicated by the dashed lines which are located at the same elevation with the dashed line extending across the top of weir edges 78. In this regard, it is noted that the total resistance to flow of the hot water presented by the distribution pipes 58, 68, branch arms 60, 70 and nozzles 62, 72 is engineered to ensure in this illustrative example that the level of water within the distribution box 38 rises to the elevation of the weir edges 78 when the flow rate equals 30% of full load capacity.

As the flow rate of water through the riser 26 increases and exceeds 30% of full load, the increased head of the water causes the latter to rise above the weir edges 78 and spill into the upper conduits 44. After a short period of time, the level of water within the upper conduits 44 approaches the elevation of the distribution pipes 50 and water is then dispersed from nozzles 54 in the inner distribution zone 34 toward the inner, central region 36 of fill assembly 28, while water also continues to be discharged by nozzles 62, 72 toward the four outer regions 32 of fill assembly 28.

Figure 9:
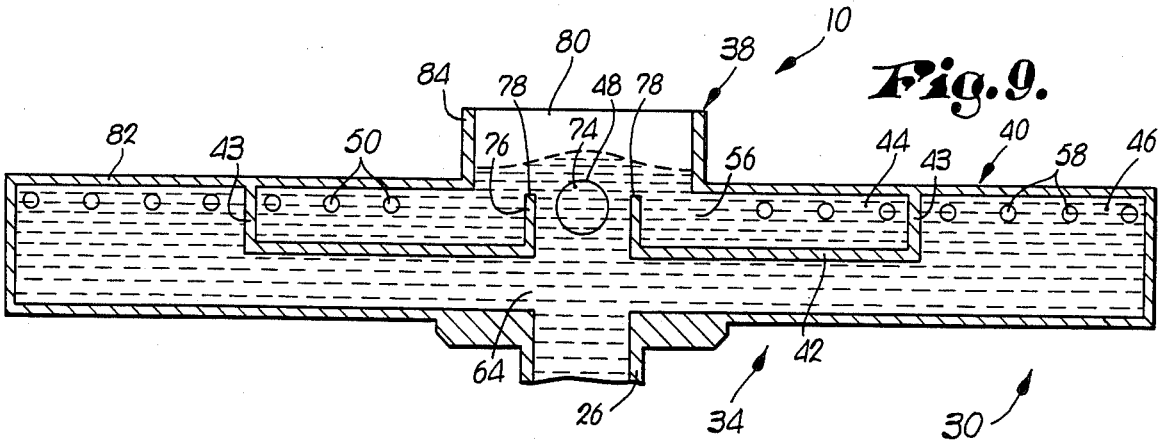
FIG. 9 is a view somewhat similar to FIG. 7 except that the flow rate of incoming hot water has reached 100% of full load capacity and the level of water has risen above the weir member to supply water to the inner distribution zone while water continues to flow to the outer distribution zone.

FIG. 9 schematically depicts flow conditions within the zoned distribution system of tower 10 when the flow rate of incoming hot water is equal to 100% of maximum, full load capacity. As shown, the height of the water level is substantially above the weir edges 78 and rises in the stilling chamber 80 above the closed tops 82 of distribution conduits 40. In this condition, closed tops 82 function to pressurize respective conduits 40, including both the upper conduits 44 and the lower conduits 46, and the total head of the water is determined by the average elevation of water within stilling chamber 80.

The distribution box 38, including weir members 76 and partition walls 42 and 43, represent fixed structure for equalizing the pressure of hot water encountered by each of the nozzles 54, 62 with the pressure of hot water encountered by each of the nozzles 72 during the time that the flow rate of water exceeds 30%. In addition, whenever the flow rate is increased or decreased to other values which are also above 30% of maximum load, the pressure encountered by all of the nozzles 54, 62 and 72 rises or falls correspondingly, but the pressure at each nozzle 54, 62, or 72 remains equal to the pressure at all other nozzles due in part to the common elevation of the distribution pipes 50, 58, 68 and the fact that the head encountered by all of the nozzles 54, 62, 72 is determined by the elevation of water above the weir edges 78. Also, all nozzles 62, 72 encounter an equal head when the level of water within the distribution box 38 falls below the top of weir edges 78 regardless of subsequent variations in the incoming flow rate.

The distribution system of the tower 10 shown in FIGS. 1–9 may be advantageously employed for use with an electric generation facility that includes a base load plant continuously operating at near full load capacity along with a peaking plant that is brought on-line in accordance with hourly changes in demand. The automatic, valve-less distribution system of the present invention assures that sufficient water is directed to the predetermined regions of the fill assembly 28 so that the distribution pipes in current use are substantially full and the associated nozzles encounter a water head which is adequate for ensuring that the associated areas of the underlying fill uniformly receive the dispersed water without formation of localized, dry spots or areas.

During winter operation, water flow rates to the tower 10 may be reduced by a significant factor to avoid excess cooling of the process water, and such flow rate reductions may be effected by causing a portion of the water to bypass the tower or by reducing the number of pumps in operation. In such instances, weir members 76 cause all of the incoming flow of hot water to be directed only through the lower conduits 46 and the cylindrical conduits 48 toward the four outer, peripheral regions 32 of the fill assembly 28. Nozzles 62, 72 associated with the four regions 32 enable a peripheral "curtain" of water to fall from the fill assembly 28 around the inside, lower perimeter of the tower shell 18 which in turn decreases the velocity of the upwardly moving air through air passageway 20 to further reduce the cooling effect caused by thermal interaction of air with the water.

Under certain circumstances, it may be desirable to control water flow through the plant by providing a plurality of pumps so that the flow rate of hot water can be determined by the number of pumps operating at any one time. For example, if a total of three pumps are utilized, one pump may produce a flow rate of 40% of maximum load, and in such a case it may be advantageous to raise the elevation of the upper weir edges 78 in order to direct all of the water to the four outer regions 32 when only one pump is actuated. When additional pumps are actuated, water is dispersed over the entire area of the fill assembly 28 without the need for operation of valves or gates at any point along the water piping.

It is to be realized, of course, that various modifications may be made to the currently preferred embodiment of the distribution system shown in FIGS. 1–9 without departing from the essence of the invention. For example, the number and configuration of the conduits radially extending toward outer regions of the fill assembly may readily be altered. Further, the distribution system may be used with other types of counterflow towers such as an octagonal mechanical draft tower instead of the illustrated, natural draft tower, and the fill assembly 28 may be, for example, sheets of corrugated, synthetic resinous film or be of a splash type with a series of horizontal splash bars. Accordingly, the invention should be deemed to be limited only by a fair scope of the claims which follow and their mechanical equivalents.

I claim:

1. In combination with a counterflow cooling tower having upright wall means defining an air passageway and a fill assembly extending across said passageway, a hot water distribution system comprising:

riser means for receiving hot water at a variable flow rate;

elongated conduit means connected to said riser means for receiving hot water from the latter;

a plurality of distribution pipes connected at space locations along the length of said conduit means for conveying hot water to an outer distribution zone located over a first, peripheral region of said fill assembly and adjacent said wall means of said tower, and for conveying hot water to an inner distribution zone located over a second, inner region of said fill assembly end within a central region of said passageway;

a first plurality of nozzle means connected to said distribution pipes for delivering hot water directed to said outer distribution zone to said first region of said fill assembly;

a second plurality of nozzle means connected to said distribution pipes for delivering hot water directed to said inner distribution zone to said second region of said fill assembly; and means for directing hot water only to said first plurality of nozzle means and thereby to said outer distribution zone whenever the flow rate of hot water passing through said riser means is any one of a number of values below a certain, preselected value, and for directing hot water to both said first plurality of nozzles and to said second plurality of nozzles and thereby to both said inner and said outer distribution zone whenever the flow rate of hot water passing through said riser means is any one of a number of values above said certain, preselected value, said directing means including structure for continuously equalizing the pressure of hot water encountered by each of said first plurality of nozzle means with the pressure of hot water encountered by each of said second plurality of nozzle means when the flow rate of water passing through said riser means is any one of a number of values which each exceed said certain, pre-selected value.

2. The invention as set forth in claim 1, wherein said directing means includes means defining a first opening in said riser means for directing hot water to said first plurality of nozzle means, and said directing means also includes means defining a second opening in said riser means for directing hot water to said second plurality of nozzle means.

3. The invention as set forth in claim 2, wherein said directing means includes a horizontally extending weir member adjacent said second opening in said riser means.

4. The invention as set forth in claim 3; including walls defining a stilling chamber above said riser means and surrounding said weir member.

5. The invention as set forth in claim 4, wherein said conduit means has a closed top enabling the pressure of water encountered by each of said nozzle means to be determined by the height of water in said stilling chamber whenever the flow rate of hot water passing through said riser means exceeds said certain value.

6. The invention as set forth in claim 3, wherein each of said distribution pipes extends in a horizontal direction and each of said nozzle means is located at a common elevation.

7. The invention as set forth in claim 1, wherein said first, peripheral region of fill assembly comprises four outer regions located adjacent said upright wall means of said tower and said conduit means includes four pressurizible, closed top conduits each extending horizontally away from said riser means toward a respective one of said regions.

8. The invention as set forth in claim 7, wherein said tower wall means has a circular inner periphery in horizontal section, and said second region of said fill assembly has a generally square configuration in horizontal section bounded by said four outer regions.

* * * * *